US009618009B2

(12) United States Patent
Fisher

(10) Patent No.: US 9,618,009 B2
(45) Date of Patent: Apr. 11, 2017

(54) CENTRIFUGAL BLOWER ASSEMBLY AND METHOD FOR ASSEMBLING THE SAME

(71) Applicant: Regal Beloit America, Inc., Beloit, WI (US)

(72) Inventor: David A. Fisher, Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 653 days.

(21) Appl. No.: 14/143,844

(22) Filed: Dec. 30, 2013

(65) Prior Publication Data

US 2015/0184662 A1 Jul. 2, 2015

(51) Int. Cl.
*F04D 17/10* (2006.01)
*F04D 29/42* (2006.01)
*F04D 29/44* (2006.01)

(52) U.S. Cl.
CPC ..... *F04D 29/441* (2013.01); *Y10T 29/49243* (2015.01)

(58) Field of Classification Search
CPC . F04D 17/10; F04D 29/4206; Y10T 29/49243
See application file for complete search history.

(56) References Cited

U.S. PATENT DOCUMENTS 2,188,741 A * 1/1940 Roberts ..... F24F 7/025 392/435
2,987,983 A * 6/1961 Solzman ..... F24F 7/025 181/198
3,688,479 A * 9/1972 Martinson ..... A01G 3/002 241/101.78
5,352,099 A * 10/1994 Anstine ..... F04D 17/165 122/13.01
6,231,311 B1 * 5/2001 Gatley ..... F04D 25/082 122/17.1
6,253,416 B1 * 7/2001 Lauer ..... A01G 1/125 15/361
6,398,512 B2 * 6/2002 Stewart ..... F23L 17/005 417/53
6,474,981 B1 11/2002 Morgan
6,494,152 B2 12/2002 Gatley, Jr.
6,530,346 B1 * 3/2003 Coones ..... F04D 29/4253 122/4 R
6,602,058 B1 * 8/2003 Stewart ..... F04D 25/082 417/366
6,895,784 B2 5/2005 Hofmann
6,895,814 B2 5/2005 Benz
7,354,244 B2 * 4/2008 Hasbargen ..... F23L 17/005 415/212.1
8,591,183 B2 11/2013 Lyons

* cited by examiner

*Primary Examiner* — Igor Kershteyn
(74) *Attorney, Agent, or Firm* — Armstrong Teasdale LLP

(57) ABSTRACT

A blower assembly includes a motor including a rotational axis and a housing coupled to the motor. The housing includes an outlet portion configured to discharge an outlet airflow from the housing in a first direction that is substantially perpendicular to the rotational axis. The blower assembly also includes a transition piece coupled to the housing proximate the outlet portion. The transition piece includes a body portion that is configured to direct the outlet airflow in a second direction that is substantially parallel to the rotational axis.

18 Claims, 5 Drawing Sheets

CENTRIFUGAL BLOWER ASSEMBLY AND METHOD FOR ASSEMBLING THE SAME

BACKGROUND

The field of the disclosure relates generally to centrifugal blower assemblies, and more specifically, to centrifugal blower assemblies that discharge air in a direction parallel to a motor rotational axis.

Blowers and impellers are commonly used for creating a flow of either a gas or a liquid. More specifically, blowers and impellers may be used in the automotive and air handling and ventilation industries for directing large volumes of forced air, over a wide range of pressures, through a variety of air conditioning components, such as furnaces. Furnaces utilize a blower to induce a draft through the furnace to draw combustion air into a combustion chamber of the furnace where the combustion air is mixed with fuel and ignited to produce heat for the furnace. The combustion products are drawn through a heat exchanger where the heat from the combustion products is transferred to temperature controlled circulating air which is directed through the house. The combustion products exit the heat exchanger and enter the furnace blower where they are propelled from the furnace blower through a discharge outlet into exhaust piping that leads to the outside atmosphere.

At least some known blower assemblies include an outlet that discharges air in a direction perpendicular to that of a rotational axis of the blower motor. However, at least some known furnaces require the use of existing exhaust piping to channel the discharge air out of vent openings in the furnace cabinet that are at permanent predetermined locations. Such hardware requires that the discharge air exits the blower outlet in a direction parallel to the motor rotational axis. Furthermore, the existing furnace exhaust piping has a generally circular cross-section, whereas at least some known blower assemblies include outlets having a generally rectangular cross-section. Thus, in order to couple the blower outlet to the exhaust piping, a structure is required that modifies the outlet airflow direction and that converts the rectangular blower outlet into a circular exhaust port that can be connected to the circular exhaust piping.

BRIEF DESCRIPTION

In one aspect, a blower assembly is provided. The blower assembly includes a motor including a rotational axis and a housing coupled to the motor. The housing includes an outlet portion configured to discharge an outlet airflow from the housing in a first direction that is substantially perpendicular to the rotational axis. The blower assembly also includes a transition piece coupled to the housing proximate the outlet portion. The transition piece includes a cylindrical body portion that is configured to direct the outlet airflow in a second direction that is substantially parallel to the rotational axis.

In another aspect, a furnace cabinet is provided. The furnace cabinet includes a plurality of panels including a mounting panel that at least partially defines a cavity. The furnace cabinet also includes a blower assembly coupled to the mounting panel within the cavity. The blower assembly includes a motor including a rotational axis and a housing coupled to the motor. The housing includes an outlet portion configured to discharge an outlet airflow from the housing in a first direction that is substantially perpendicular to the rotational axis. The blower assembly also includes a transition piece coupled to the housing proximate the outlet portion. The transition piece includes a cylindrical body portion that is configured to direct the outlet airflow in a second direction that is substantially parallel to the rotational axis.

In yet another aspect, a method of assembling a blower assembly is provided. The method includes providing a motor that includes a rotational axis. The method further includes coupling the motor to a housing. The housing includes an outlet portion configured to discharge an outlet airflow from the housing in a first direction that is substantially perpendicular to the rotational axis. A transition piece is then coupled to the housing proximate the outlet portion such that a cylindrical body portion of the transition piece is configured to direct the outlet airflow in a second direction that is substantially parallel to the rotational axis.

DETAILED DESCRIPTION

Figure 1:
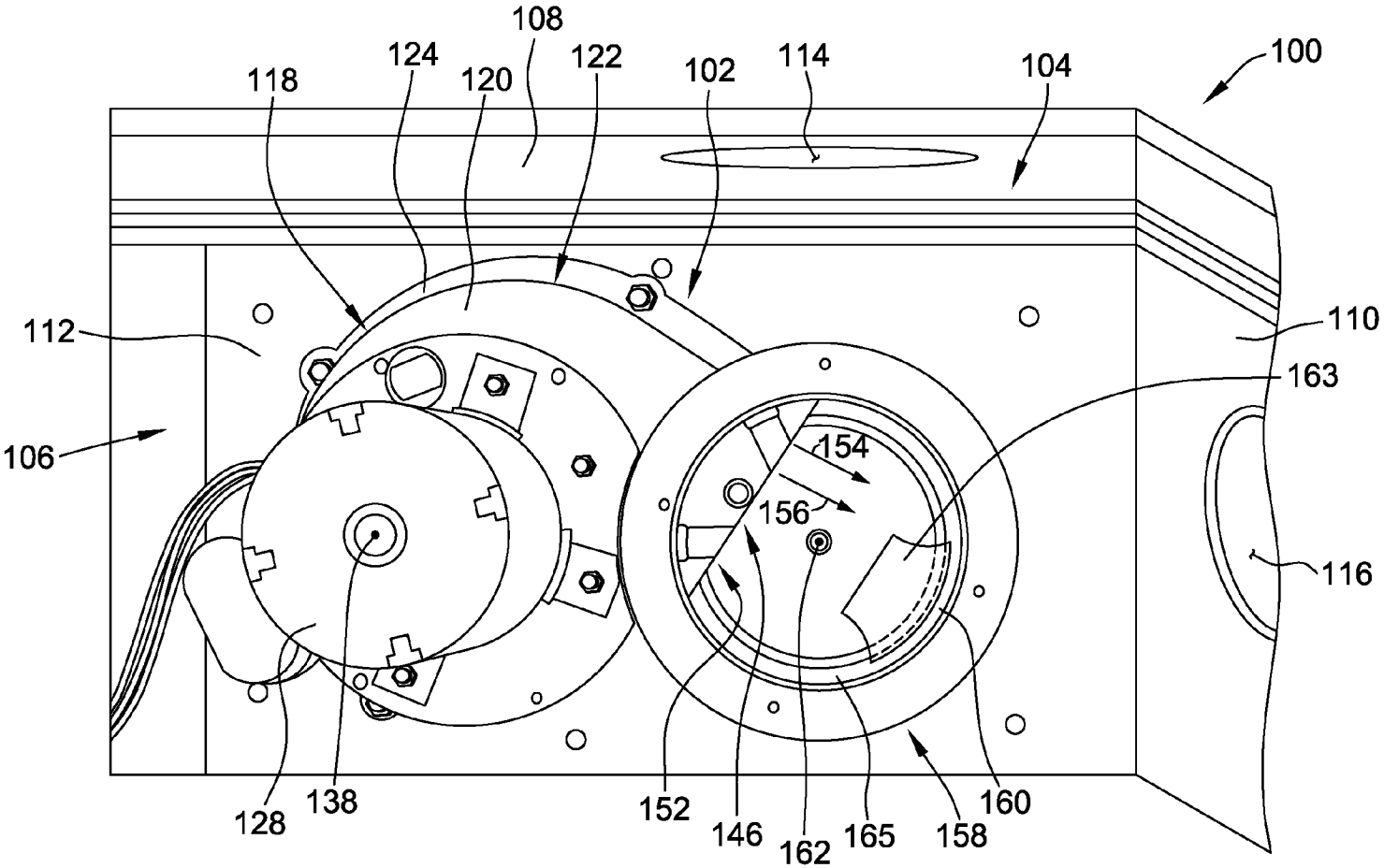
FIG. 1 illustrates a portion of an exemplary air handling system including an exemplary centrifugal blower assembly.
Figure 2:
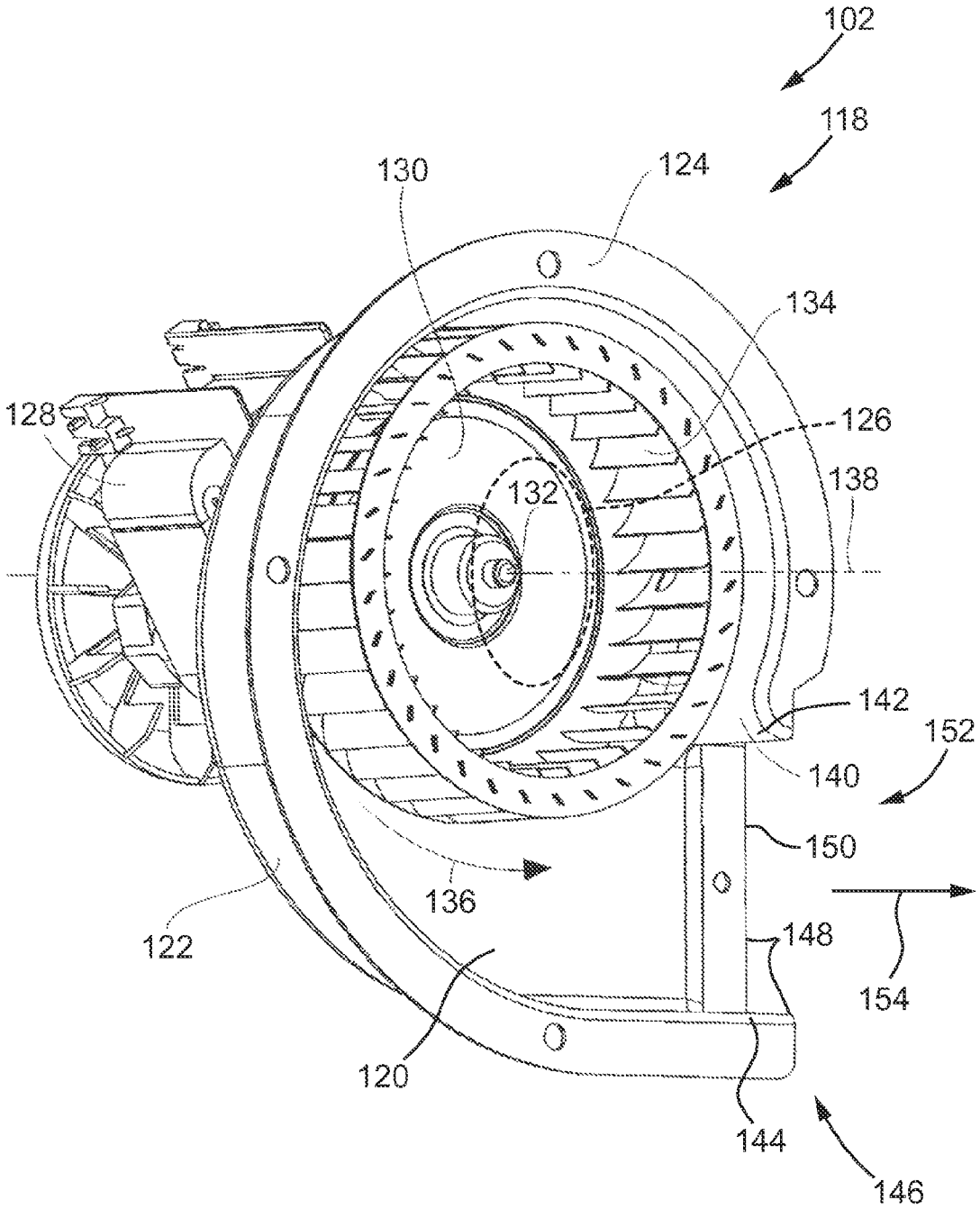
FIG. 2 is a perspective view of a portion of the centrifugal blower assembly shown in FIG. 1.

FIG. 1 illustrates a portion of an exemplary air handling system 100 including an exemplary centrifugal blower assembly 102. FIG. 2 is a perspective view of a portion of blower assembly 102 shown in FIG. 1. Air handling system 100 includes a plurality of panels 104 that at least partially define a cavity 106. The plurality of panels 104 includes at least a top panel 108, a side panel 110, and a mounting panel 112. Top panel 108 includes a top exhaust piping opening 114 configured to receive exhaust piping (not shown in FIG. 1) for channeling air from blower assembly 102 within cavity 106 to other components of air handling system 100. Similarly, side panel 110 includes a side exhaust piping opening 116 configured to facilitate channeling air to other components of air handling system 100.

In the exemplary embodiment, blower assembly 102 is coupled to mounting panel 112 and is configured to produce a flow of air for air handling system 100. In the exemplary embodiment, air handling system 100 is one of a residential or a commercial HVAC system. Alternatively, air handling system 100 is any air moving system. Blower assembly 102 includes a blower housing 118 that may be made from stamped metal components, for example, or from suitable rigid plastics. Alternatively, housing 118 may be integrally formed as a single die cast piece of materials such as, but not limited to, aluminum and plastics. Blower housing 118 includes a top wall or end wall 120 and a side wall 122 extending substantially perpendicularly from end wall 120. Side wall 122 includes a flange 124 by which a cover member (not shown) may be secured to side wall 122 such as by separate mechanical fasteners, by crimping or welding. The cover member also includes a circular inlet opening 126 represented by dashed lines in FIG. 2. Alternatively, housing 118 may not include a cover portion and mounting panel 112 may include an inlet opening such that flange 124 may be mounted to mounting panel 112.

A motor 128 is coupled to and supported by end wall 120 of blower housing 118 via suitable fasteners (not shown) or some other equivalent connection. An impeller or fan wheel 130 is coupled to an output shaft 132 of motor 128 and is positioned within the interior of blower housing 118. In the exemplary embodiment, fan wheel 130 is a "squirrel cage" or "sirocco" type wheel that includes a plurality of blades 134 that are circumferentially spaced about a hub (not shown). In some known centrifugal blowers, blade shapes include one of a backward curved blade, an airfoil blade, a backward inclined blade, a forward curved blade, and a radial blade. In the exemplary embodiment, blades 134 are forward curved blades with respect to the rotation direction of fan wheel 130 and of air flow, indicated by arrow 136. Alternatively, fan wheel 130 may have any suitable blade shape, for example radial blades or airfoil blades, that enables blower assembly 102 to operate as described herein.

Output shaft 132 and fan wheel 130 rotate in the rotational direction 136 about a rotational axis 138. Rotational axis 138 defines mutually perpendicular axial and radial directions relative to blower assembly 102. There are no obstructions inside fan wheel 130 radially between motor output shaft 132 and plurality of blades 134 surrounding shaft 132. This enables an unobstructed flow of air axially through blower housing inlet opening 126 into the interior of fan wheel 130, then radially from motor output shaft 132 to fan blades 134 and through fan blades 134 around the outside of fan wheel 130 to blower housing side wall 122. Side wall 122 of blower housing 118 is generally curved or scrolled and extends in rotational direction 136 around fan wheel 130 between a housing cutoff 140, defined at a first end 142 of side wall 122, and a second end 144. In the exemplary embodiment, side wall 122, together with end wall 120 and optionally the cover member, define an outlet portion 146. Outlet portion 146 includes a substantially rectangular outlet edge 148 defined at least by distal ends of first and second side wall ends 142 and 144 and by an edge 150 of end wall 120. Outlet edge 150 defines an outlet opening 152 through which a stream of outlet airflow 154 is exhausted downstream of blower housing 118 in a first direction, illustrated by arrow 156 that is substantially perpendicular to rotational axis 138.

During operation, fan blades 134 rotate to draw air into an area of blower housing 118 proximate motor shaft 132 through inlet 126 and deflects the air radially outward from rotational axis 138. The air passes through channels defined between blades 134 and is forced outwards to side wall 122, due to the centrifugal force generated by rotating blades 134. The air is then channeled to outlet portion 146 before being exhausted from blower assembly 102 through outlet opening 152. Although blower assembly 102 is illustrated as having only one inlet 126, outlet 152, and fan wheel 130, blower assembly 100 may include any number of inlets, outlets, and fan wheels.

In the exemplary embodiment, blower assembly 102 further includes a transition piece 158 coupled to housing 118 proximate outlet portion 146. Transition piece 158 is configured to receive outlet airflow 154 from outlet opening 152 of outlet portion 146 and turn airflow 154 from first direction 156 to a second direction (not shown in FIG. 1 or 2), as described in further detail below. In the exemplary embodiment, transition piece 158 is integrally formed from a metallic material selected from the group including stainless steel, aluminum, carbon steel, or any combination thereof. Alternatively, transition piece 158 may be formed from separate components. Generally, transition piece 158 may be formed integrally or from multiple pieces of any material that facilitates operation of blower assembly 102 as described herein.

Transition piece 158 includes a substantially cylindrical body portion 160 that defines a longitudinal axis 162. Longitudinal axis 162 is parallel to rotational axis 138 of motor 128 and is offset from rotational axis 138 by a predetermined distance. Furthermore, longitudinal axis 162 is substantially perpendicular to first direction 156. In the exemplary embodiment, transition piece body portion 160 includes an aperture 164 (shown in FIG. 3) and is coupled to housing 118 such that aperture 164 is configured to receive at least a portion of outlet portion 146 therethrough. More specifically, a portion of outlet portion 146, including at least outlet edge 148 and outlet opening 152, is configured to be inserted into aperture 164 such that outlet airflow 154 is discharged from outlet opening 152 of outlet portion 146 into body portion 160 of transition piece 158. Alternatively, transition piece 158 may be integrally formed with housing 118. In the exemplary embodiment, outlet portion 146 extends into body portion 160 through aperture 164 a distance of approximately 0.75 inches. Alternatively, outlet portion 146 may extend into body portion 160 any distance that facilitates operation of blower assembly as described herein, or outlet portion 146 may not extend into transition piece, but may be substantially flush with body portion 160. Furthermore, aperture 164 includes a shape that is complementary to a shape of outlet edge 148. More specifically, aperture 164 is substantially rectangular to facilitate inserting rectangular outlet edge 148 of outlet portion 146 into aperture 164 with minimal clearance therebetween.

In the exemplary embodiment, transition piece 158 also includes a guide plate 163 coupled to an inner surface of body portion 160. More specifically, guide plate 163 is coupled within body portion 160 substantially across from aperture 164 and outlet opening 152. Guide plate 163 is configured prevent direct impingement of outlet airflow 154 onto body portion 160, which is oriented perpendicular to direction 164 of airflow 154. Furthermore, in the exemplary embodiment, guide plate 163 is curved such that outlet airflow 154 impinges on the curved surface and is directed towards the second direction within transition piece 158. Alternatively, guide plate 163 may be a substantially flat plate that is positioned at an angle with respect to first direction 156 to guide outlet airflow 154 along longitudinal axis 162 of body portion 160. Transition piece 158 is configured to receive outlet airflow 154 from outlet opening 152 of outlet portion 146 and turn airflow 154 from first direction 156 to the second direction, wherein the second direction is parallel to both rotational and longitudinal axes 138 and 162.

Figure 3:
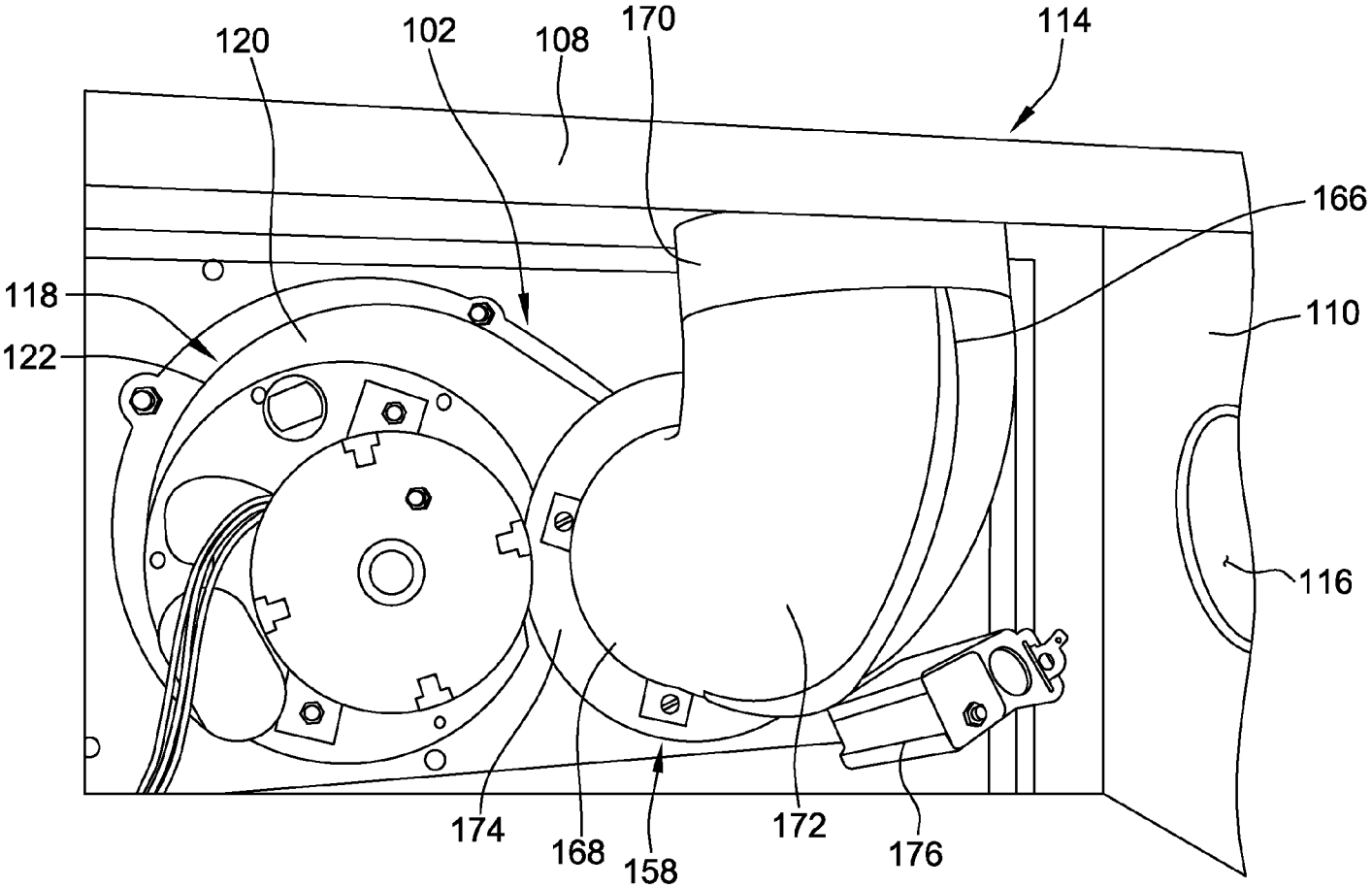
FIG. 3 is another interior view of the furnace cabinet assembly including exemplary exhaust piping.

FIG. 3 is an interior view of cavity 106 including blower assembly 102 and an exhaust structure 166 that is configured to channel outlet airflow 154 (shown in FIGS. 1 and 2) from transition piece 158 to other components of air handling system 100. In the exemplary embodiment, exhaust structure 166 includes a first end 168 and a second end 170, and a bend 172 therebetween. Bend 172 is a substantially 90° bend that channels outlet airflow 154 through at least one of top and/or side exhaust openings 114 and 116 in top and/or side panel 108 and 110, respectively. More specifically, first end 168 is coupled about an outer circumference of body portion 160 (shown in FIGS. 1 and 2) and second end 170 extends through one of openings 114 and 116 to channel airflow 154 from blower assembly 102. Transition piece 158 includes a collar 174 coupled to an exterior surface of body portion 160. Collar 174 is further coupled to first end 168 of exhaust structure 166 and is configured to properly position exhaust structure 166 along a length of body portion 160 such that second end 170 is aligned with one of openings 114 and/or 116. Exhaust structure 166 further includes a probe device 176 coupled thereto. Probe device 176 is exposed to outlet airflow 154 within exhaust structure 166 and is configured to measure at least one parameter of outlet airflow 154. In the exemplary embodiment, probe device 176 is a safety switch that measures a temperature of outlet airflow 154 within exhaust structure 166 and may either display the temperature or relay an electronic signal indicative of the temperature to a controller (not shown). Alternatively, probe device may be any type of sensor probe that measures any parameter of outlet airflow 154, such as, but not limited to, density, mass flow rate, and chemical makeup.

Figure 4:
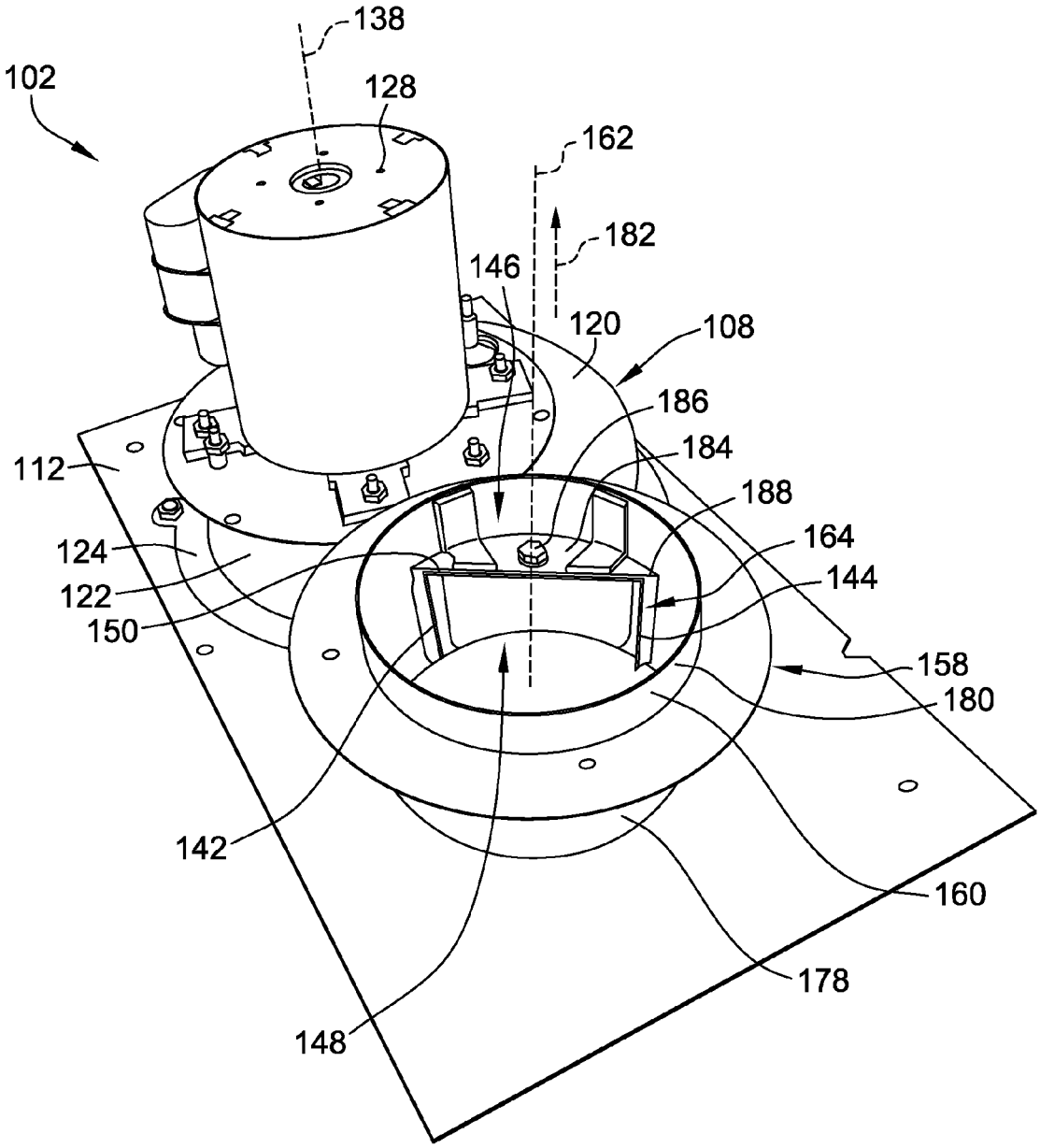
FIG. 4 is a perspective side view of the centrifugal blower assembly shown in FIG. 1 including an exemplary transition piece.
Figure 5:
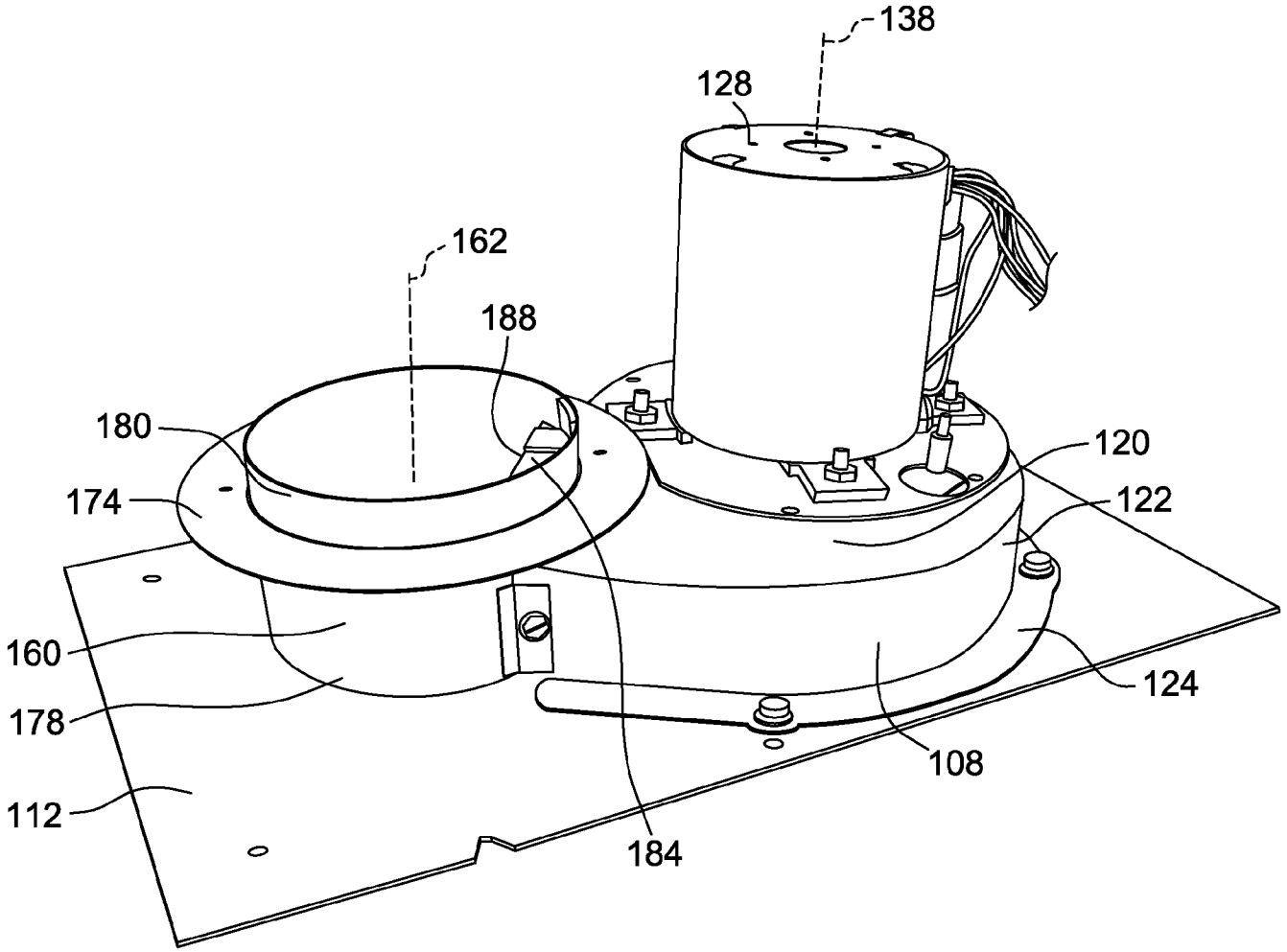
FIG. 5 is a perspective top view of the centrifugal blower assembly shown in FIG. 4 including the transition piece.

FIGS. 4 and 5 are perspective side and top views, respectively, of blower assembly 102 that may be used in air handling system 100. As described above, blower assembly 102 includes housing 118 made up of at least end wall 120, side wall 122, and flange 124, which is coupled to mounting panel 112. Furthermore, motor 128, having rotational axis 138, is coupled to end wall 120. Housing 118 further includes outlet portion 146 that includes outlet edge 148 defining outlet opening 152. Blower assembly 102 also includes transition piece 158 coupled to outlet portion 146 such that a portion of outlet portion 146 extends through body portion 160 into transition piece 158. Body portion 160 defines longitudinal axis 162 and includes a first end 178 and a second end 180. First end 178 is coupled to mounting panel 112 and is substantially coplanar with flange 124. Second end 180 is open to facilitate channeling outlet airflow from transition piece 158 in a second direction 182 that is parallel to both axes 138 and 162.

In the exemplary embodiment, aperture 164 extends from first end 178 substantially halfway along a length of body portion 160 toward second end 180. Alternatively, aperture 164 may extend any distance between any two points along body portion 160. Generally, aperture 164 has a shape that is complementary to the shape of outlet edge 148 such that there is no gap between aperture 164 and outlet portion 146. As described above, outlet edge 148 includes end wall edge 150 and both first and second ends 142 and 144 of side wall 122.

In the exemplary embodiment, transition piece 158 further includes a mounting plate 184 that extends inwards from inner surface 165 of body portion 160. Mounting plate 184 is a substantially flat plate that parallel to end wall 120 and is configured to couple transition piece 158 to outlet portion 146 of housing 118. More specifically, mounting plate 184 is coupled to a portion end wall 120 of outlet portion 146 using at least one fastener 186. Alternatively, mounting plate 184 may be coupled to outlet portion 146 by any comparable means, such as, but not limited to, brackets or welding. Mounting plate 184 includes a distal edge 188 that is substantially flush with outlet edge 148, and, more specifically, with edge 150 of end wall 120 such that mounting plate 184 extends a distance into body portion 160 approximately equal to the distance outlet portion 146 is inserted through aperture 164.

In operation, fan wheel 130 rotates about rotational axis 138 to drawn air into housing 118 through inlet 126. The air then passes through blades 134 and is exhausted from housing 118 through outlet opening 152 in first direction 156 substantially perpendicular to rotational axis 138. Outlet airflow 154 then flows into transition piece 160, which includes aperture 164 configured to receive at least a portion of housing outlet portion 146. Guide plate 163 is configured to direct outlet airflow 154 from first end 178 of transition piece body portion 160 in second direction 182 to second end 180 along longitudinal axis 162, which is parallel to rotational axis 138. Exhaust structure 166 is coupled to second end 180 of body portion 160 and channels outlet airflow 154 through at least one of top and/or side exhaust piping openings 114 and 116 located in top and side panels, respectively. By inserting the outlet portion of the housing assembly partially into the transition piece, the transition piece enables the use of pre-existing exhaust structure hardware with the exemplary blower assembly. The transition piece does so by turning the outlet airflow from its first direction as it exits the outlet perpendicular to the rotational axis to the second direction parallel with the rotational axis. Redirecting the outlet airflow substantially 90 degrees facilitates using the pre-existing exhaust structure to channel the outlet airflow form the blower assembly and to other components of the air handling system.

The embodiments described herein relate to a blower assembly including a transition piece and methods for assembling the same. More specifically, the embodiments relate to a blower assembly that includes a transition piece that turns an outlet airflow to enable use of existing exhaust piping to channel the airflow out of the blower assembly. More particularly, the embodiments relate to a blower assembly that includes a blower housing and a transition piece coupled to the outlet of the housing. The transition piece is configured to steer the outlet airflow from a first direction perpendicular to a motor rotational axis to a second direction parallel to the rotational axis. The methods and apparatus are not limited to the specific embodiments described herein, but rather, components of apparatus and/or steps of the methods may be utilized independently and separately from other components and/or steps described herein. For example, the methods may also be used in combination with a backward curved fan or blower assembly, and are not limited to practice with only the forward curved fan as described herein. In addition, the exemplary embodiment can be implemented and utilized in connection with many other residential or commercial HVAC applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blower assembly comprising:

a motor comprising a rotational axis;

a housing coupled to said motor, said housing comprising an outlet portion, wherein said outlet portion is configured to discharge an outlet airflow from said housing in a first direction that is substantially perpendicular to said rotational axis; and a transition piece coupled to said housing proximate said outlet portion, wherein said transition piece comprises a body portion that is configured to direct the outlet airflow in a second direction that is substantially parallel to said rotational axis, wherein said transition piece further comprises a guide plate coupled within said body portion opposite said outlet portion, said guide plate configured to direct the outlet airflow toward said second direction.

2. The blower assembly in accordance with claim 1, wherein said transition piece comprises an aperture formed in said body portion, said aperture configured to receive at least a portion of said outlet portion therethrough such that the outlet airflow is discharged from said outlet portion into said transition piece.

3. The blower assembly in accordance with claim 2, wherein said body portion is substantially cylindrical and includes a first end and an opposing second end, and wherein said aperture extends from said first end toward said second end.

4. The blower assembly in accordance with claim 2, wherein said outlet portion includes an outlet edge, and wherein said aperture comprises a shape that is complementary to a shape of said outlet edge.

5. The blower assembly in accordance with claim 1, wherein said transition piece comprises a collar coupled to an exterior surface of said body portion.

6. The blower assembly in accordance with claim 1, wherein said transition piece comprises a mounting plate that extends inward from an inner surface of said body portion, said mounting plate configured to couple said transition piece to said outlet portion.

7. The blower assembly in accordance with claim 1, wherein said transition piece is integrally formed from a metallic material selected from the group consisting of aluminum, stainless steel, carbon steel, or any combination thereof.

8. An air handling system comprising:

a plurality of panels that at least partially define a cavity, wherein said plurality of panels comprises a mounting panel; and a blower assembly coupled to said mounting panel within said cavity, said blower assembly comprising:

a motor comprising a rotational axis;

a housing coupled to said motor, said housing comprising an outlet portion configured to discharge an outlet airflow from said housing in a first direction that is substantially perpendicular to said rotational axis; and a transition piece coupled to said housing proximate said outlet portion, wherein said transition piece comprises a body portion that is configured to direct the outlet airflow in a second direction that is substantially parallel to said rotational axis, wherein said transition piece comprises an aperture formed in said body portion, said aperture configured to receive at least a portion of said outlet portion therethrough such that the outlet airflow is discharged from said outlet portion into said transition piece.

9. The air handling system in accordance with claim 8, wherein said plurality of panels further comprises a top panel and a side panel, said top panel and said side panel each including a piping opening.

10. The air handling system in accordance with claim 8 further comprising an exhaust structure coupled to said transition piece, said exhaust structure configured to channel the outlet airflow from said transition piece through at least one of said piping openings.

11. The air handling system in accordance with claim 10, wherein said transition piece includes a collar coupled to an exterior surface of said body portion, said collar configured to facilitate positioning said exhaust structure.

12. The air handling system in accordance with claim 10 further comprising a probe device coupled to said exhaust structure, wherein said probe device is configured to measure at least one parameter of the outlet airflow within said exhaust structure.

13. The air handling system in accordance with claim 8, wherein said transition piece comprises a guide plate coupled within said body portion opposite said outlet portion, said guide plate configured to direct the outlet airflow toward said second direction.

14. A method of assembling a blower assembly, said method comprising:

providing a motor that includes a rotational axis;

coupling the motor to a housing, wherein the housing includes an outlet portion configured to discharge an outlet airflow from the housing in a first direction that is substantially perpendicular to the rotational axis;

coupling a transition piece to the housing proximate the outlet portion such that a body portion of the transition piece is configured to direct the outlet airflow in a second direction that is substantially parallel to the rotational axis; and coupling a guide plate within said body portion opposite said outlet portion, wherein the guide plate is configured to direct the outlet airflow toward the second direction.

15. The method in accordance with claim 14, wherein coupling a transition piece to the housing further comprises inserting at least a portion of the outlet portion into an aperture formed in the body portion such that the outlet airflow is discharged from said outlet portion into said transition piece.

16. The method in accordance with claim 14 further comprising coupling a collar to an exterior surface of the body portion.

17. The method in accordance with claim 14, wherein coupling a transition piece to the housing further comprises coupling a mounting plate to an inner surface of the body portion and to at least a portion of the outlet portion within the body portion.

18. An air handling system comprising:

a plurality of panels that at least partially define a cavity, wherein said plurality of panels comprises a mounting panel, a top panel and a side panel, wherein said top panel and said side panel each include a piping opening; and a blower assembly coupled to said mounting panel within said cavity, said blower assembly comprising:

a motor comprising a rotational axis;

a housing coupled to said motor, said housing comprising an outlet portion configured to discharge an outlet airflow from said housing in a first direction that is substantially perpendicular to said rotational axis; and a transition piece coupled to said housing proximate said outlet portion, wherein said transition piece comprises a body portion that is configured to direct the outlet airflow in a second direction that is substantially parallel to said rotational axis.

* * * * *